US009447605B1

(12) United States Patent
Clifford et al.

(10) Patent No.: US 9,447,605 B1
(45) Date of Patent: Sep. 20, 2016

(54) KEY AND LOCK CYLINDER

(71) Applicant: Schlage Lock Company LLC, Indianapolis, IN (US)

(72) Inventors: Jason Curtis Clifford, Colorado Springs, CO (US); Brian Edward Walls, Colorado Springs, CO (US); Evan Earl Evans, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/644,712

(22) Filed: Mar. 11, 2015

(51) Int. Cl.

| | |
|---|---|
| ***E05B 27/00*** | (2006.01) |
| ***E05B 19/00*** | (2006.01) |
| ***E05B 29/00*** | (2006.01) |
| ***E05B 47/00*** | (2006.01) |

(52) U.S. Cl.
CPC ..... *E05B 27/0003* (2013.01); *E05B 19/0052* (2013.01); *E05B 29/0066* (2013.01); *E05B 47/0044* (2013.01); *Y10T 70/7605* (2015.04)

(58) Field of Classification Search
CPC ..... Y10T 70/7605; Y10T 70/7616; Y10T 70/7599; Y10T 70/765; Y10T 70/7932; Y10T 70/7695; Y10T 70/7944; Y10T 70/7593; Y10T 70/7689; Y10T 70/7881; E05B 19/0052; E05B 29/0066; E05B 47/0044; E05B 27/0003
USPC ..... 70/492, 377, 405, 406, 409, 495, 427, 70/453, 454, 389, 419, 421
See application file for complete search history.

(56) References Cited

U.S. PATENT DOCUMENTS 1,364,452 A * 1/1921 Renaux ..... E05B 27/0035 70/357
2,375,682 A * 5/1945 Olson ..... E05B 29/00 70/419
3,509,749 A * 5/1970 Arzig ..... E05B 29/004 70/375
3,531,959 A * 10/1970 Weber ..... E05B 27/0042 70/216
3,555,859 A * 1/1971 Berkowitz ..... E05B 29/00 70/340

(Continued)

*Primary Examiner* — Suzanne Barrett
(74) *Attorney, Agent, or Firm* — Taft Stettinius & Hollister LLP

(57) ABSTRACT

A plug assembly for a lock includes a generally cylindrical plug body that defines a keyway and a generally cylindrical plug housing that rotatably receives the plug body. A plurality of blocking members are housed in the plug body and are movable into the keyway upon rotation of the plug body relative to the plug housing to obstruct the keyway. A key can be provided that is positionable into the keyway, and the blade of the key defines receptacles for receiving the blocking members when the plug body is rotated so that the lock can be unlocked. However, the blocking members prevent rotation of the plug body when a picking tool or unauthorized key is inserted in the keyway since either the blocking members cannot move into the keyway and remain engaged to the plug housing due to the object in the keyway, or obstruct the keyway and prevent insertion of the picking tool.

18 Claims, 4 Drawing Sheets

(56) References Cited

U.S. PATENT DOCUMENTS 3,581,534 A * 6/1971 Testa ..... E05B 29/004 70/375
3,654,782 A * 4/1972 Heimann ..... E05B 47/0042 70/276
3,990,282 A * 11/1976 Sorum ..... E05B 29/00 70/377
3,999,413 A * 12/1976 Raymond ..... E05B 29/004 70/377
4,015,458 A * 4/1977 Mercurio ..... E05B 29/00 70/377
4,044,578 A * 8/1977 Guiraud ..... E05B 29/0013 70/366
4,376,382 A * 3/1983 Raymond ..... E05B 29/004 70/338
4,524,593 A 6/1985 Hennessy
4,723,427 A * 2/1988 Oliver ..... E05B 27/0082 70/366
4,966,021 A * 10/1990 Boag ..... E05B 29/004 70/377
5,079,936 A * 1/1992 Stefanek ..... E05B 27/00 70/358
5,086,632 A 2/1992 Hsu
5,174,141 A * 12/1992 Ohyabu ..... E05B 29/00 70/377
5,823,030 A * 10/1998 Theriault ..... E05B 27/0042 70/389
5,826,451 A 10/1998 Cook
5,956,986 A * 9/1999 Vonlanthen ..... E05B 27/0035 70/492
6,041,631 A * 3/2000 Vonlanthen ..... E05B 29/00 70/413
6,427,506 B1 * 8/2002 Prunbauer ..... E05B 19/0017 70/358
6,481,255 B2 * 11/2002 Theriault ..... E05B 27/0082 70/409
6,490,898 B1 * 12/2002 Mottura ..... E05B 27/0039 70/409
RE39,364 E 10/2006 Brandt
7,225,651 B2 6/2007 Edwards et al.
7,392,677 B1 * 7/2008 Fan ..... E05B 29/00 70/377
7,810,365 B2 10/2010 Villani
7,930,916 B2 4/2011 Tamezane et al.
8,261,587 B2 * 9/2012 Haviv ..... E05B 15/1614 70/416
8,720,241 B1 * 5/2014 Widen ..... E05B 27/00 70/409
8,820,129 B2 * 9/2014 Dolev ..... E05B 27/0017 70/409
2006/0236733 A1 * 10/2006 Walter ..... E05B 27/0078 70/495
2013/0152648 A1 6/2013 Havemann et al.

* cited by examiner

KEY AND LOCK CYLINDER

TECHNICAL FIELD

The present invention generally relates to locks, and more particularly, but not exclusively, to a plug assembly for locks that hinders or prevents unauthorized access, such as through the use of lock picks and bump keys.

BACKGROUND

Lock cylinders operate by placement of a key into the keyway of the cylinder. The key aligns pins so the cylinder can be turned to open the lock. Bump keys, pick tools, or other devices that can be used to provide the required pin alignment to rotate the lock cylinder may be able to defeat the lock in some cases to provide unauthorized access. In order to prevent unauthorized access by defeating the lock of a lock cylinder, there is a need for the unique and inventive apparatuses, systems, and methods disclosed herein.

SUMMARY

In certain embodiments, a plug assembly for a lock includes a plug body that defines a keyway and a plug housing that rotatably receives the plug body. The plug body defines a plurality of slots that receive respective ones of a plurality of blocking members. The blocking members each include an outer side that includes a cam member that engages an inner surface of the plug housing, and an inner side that defines a blocking portion. In a first position of the plug body relative to the plug housing, the cam members are received in detents of the plug housing so that the blocking portions are positioned out of the path of the keyway. When the plug body is rotated relative to the plug housing, the cam members slide out of the detents and into contact with the inner surface of the plug housing, which results in a radially inward displacement, or movement transverse to the longitudinal axis of the keyway, of the blocking members relative to the plug body so the blocking portions enter and obstruct the keyway.

In another aspect, a key is provided that includes a blade with at least first and second receptacles on opposite sides thereof to receive the blocking portions of respective ones of the blocking members. Since the blocking members are received in the receptacles as the plug body is rotated, the key can be positioned in the keyway without interference from the blocking member and used to open the lock. However, in the event an unauthorized key or pick tool without the required number, size and positioning of receptacles to receive the blocking members is used to rotate the lock, the blocking members either enter the keyway and contact or jam the key or pick tool, or are prevented from disengaging the detents by the key or pick tool. This jams the key or tool between the blocking members in the keyway and prevents the plug body from rotating further relative to the plug housing.

While it contemplated at least two blocking members are provided with one blocking member on each side of the keyway, more than two blocking members are also possible. The associated key would have a corresponding number of receptacles in an appropriate size, spacing and alignment to receive the blocking members. The blocking members can be employed in plug assemblies that employ either sidebar locking members that extend along the keyway, or in pin arrangements.

Still other embodiments include apparatuses, systems, devices, hardware, methods, and combinations for the same. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
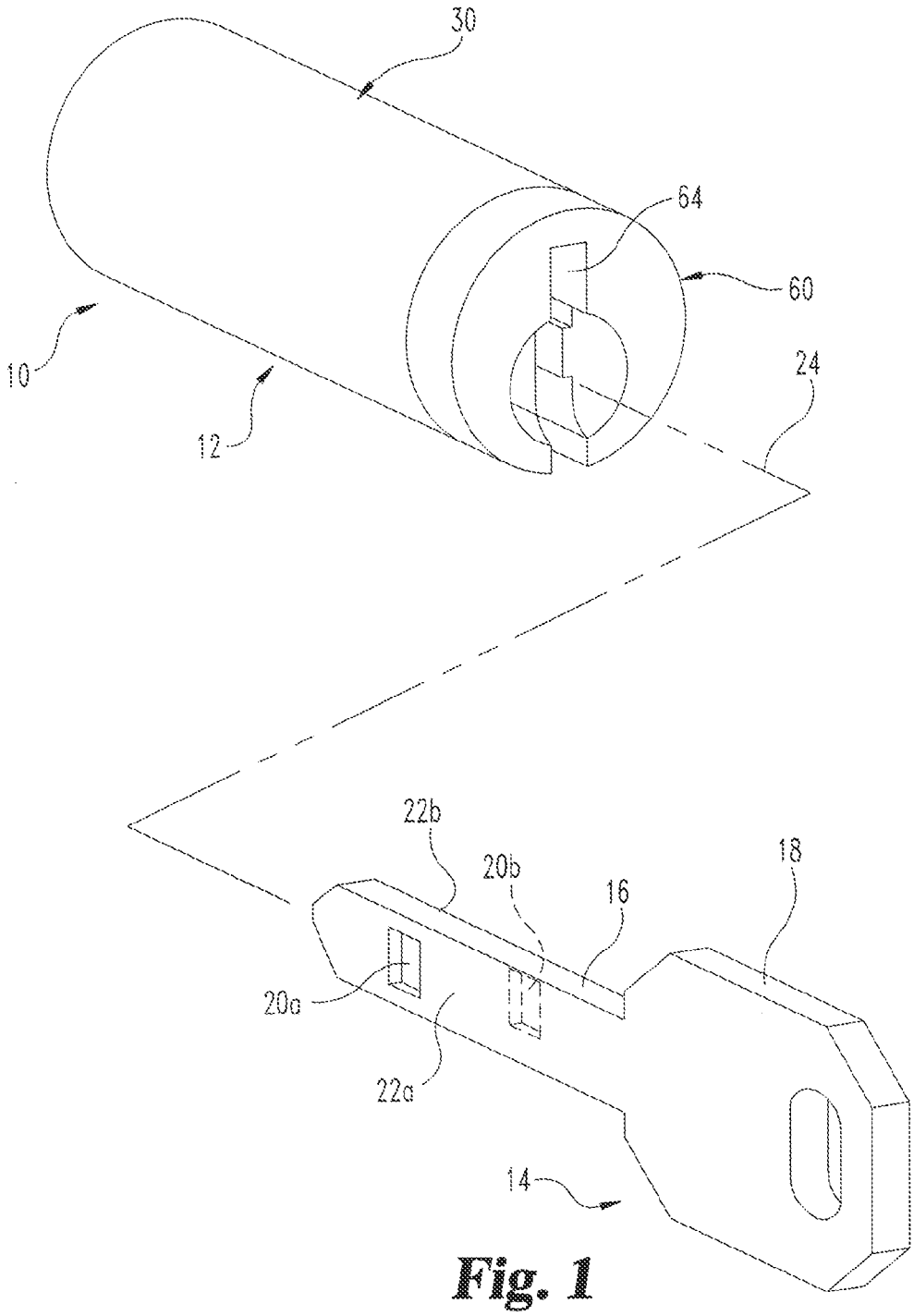
FIG. 1 is a perspective illustration of a plug assembly and associated key for a lock according to an embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, a reference to the length, height, or width of an element of a plug assembly for a lock is to be interpreted in light of the following characterization of the dimensions and definitions unless specifically noted otherwise. The geometry of the plug assembly is cylindrical and defines three mutually orthogonal axes; each dimension is measured along one of the axes. Length is measured along a longitudinal axis defined as the axial direction of the cylinder and is the direction in which the keyway extends from its opening. Height is measured along a vertical axis, the direction in which the bittings are formed on a corresponding key, which will also be referred to as the vertical direction. The center of the key is bisected by a central vertical axis. Width is measured along the horizontal axis, which will be referred to as the horizontal direction. These terms are used for ease and convenience of description, and are without regard to the orientation of a system with respect to the environment. For example, descriptions that reference a vertical direction are equally applicable when the system is in a horizontal orientation or an off-axis orientation. Therefore the terms are not to be construed as limiting the scope of the subject matter herein.

With reference to FIG. 1, an illustrative lock 10 includes a plug assembly 12 and a key 14. Plug assembly 12 includes an outer, cylindrical plug housing 30 and an inner plug body 60 that is rotatably housed in plug housing 30. The plug assembly 12 may further include a tower (not shown) configured to allow the plug assembly 12 to be installed into an existing cylinder housing, such as a small format interchangeable core (SFIC) housing (not shown.) It is also contemplated that the plug housing 12 may be of another configuration, such as full size, mortise, rim, or key-in-knob/lever.

With additional reference to FIGS. 2 through 5, the plug body 60 is positioned partially within a generally cylindrical chamber 32 defined by the plug housing 30. The plug body 60 includes a faceplate 62 and a keyway 64 extending along a longitudinal axis 24 of plug assembly 12, and keyway 64 opens through faceplate 62 to receive key 14. Plug body 60 further includes a plurality of slots 66*a*, 66*b* that receive respective ones of a plurality of blocking members 68*a*, 68*b*. Slots 66*a*, 66*b* extend from an outer surface 88 of plug body 60 to keyway 64.

Figure 2:
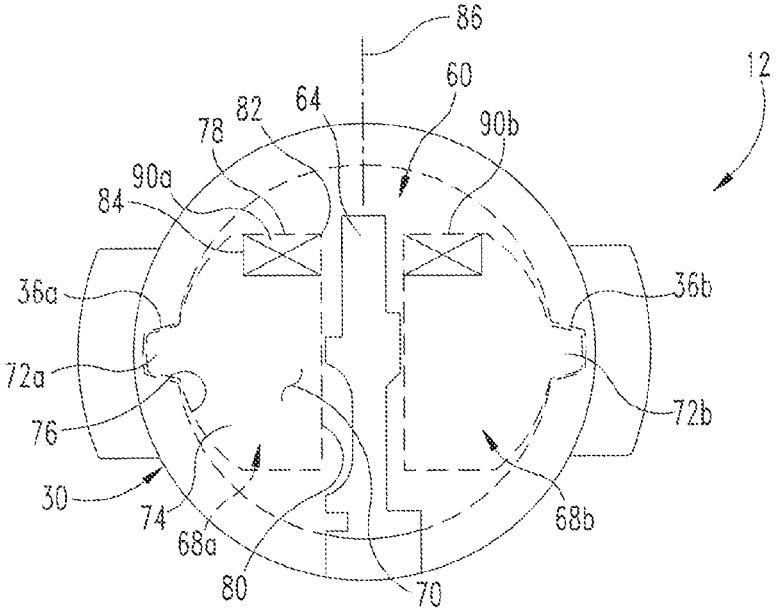
FIG. 2 is a diagrammatic cross-sectional view of the plug assembly of FIG. 1 in a locked state.
Figure 3:
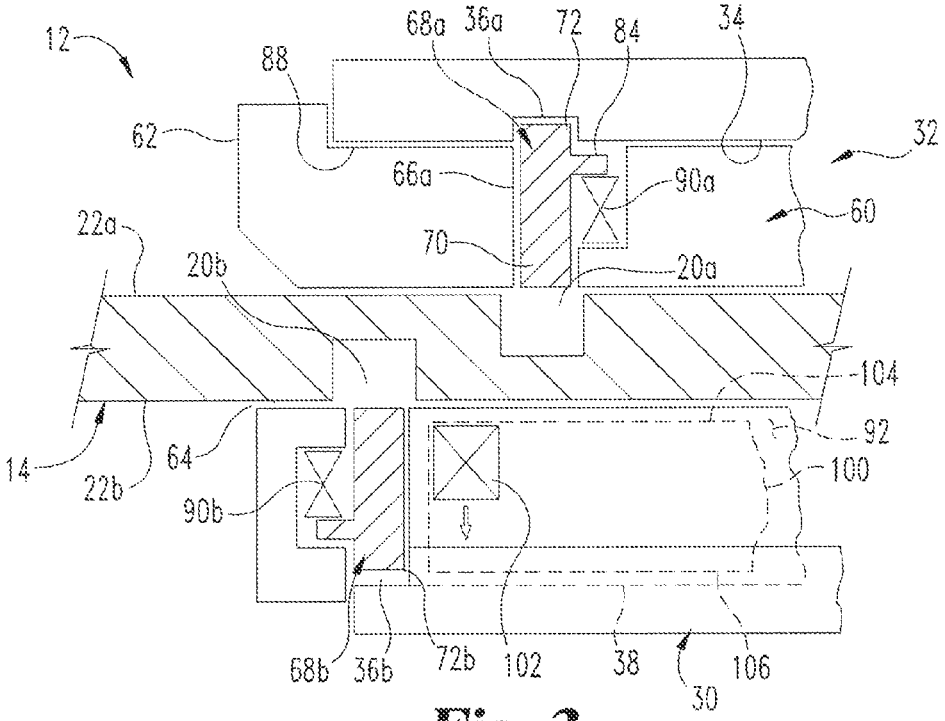
FIG. 3 is a diagrammatic longitudinal sectional view of the plug assembly of FIG. 2 with a key in the keyway.
Figure 4:
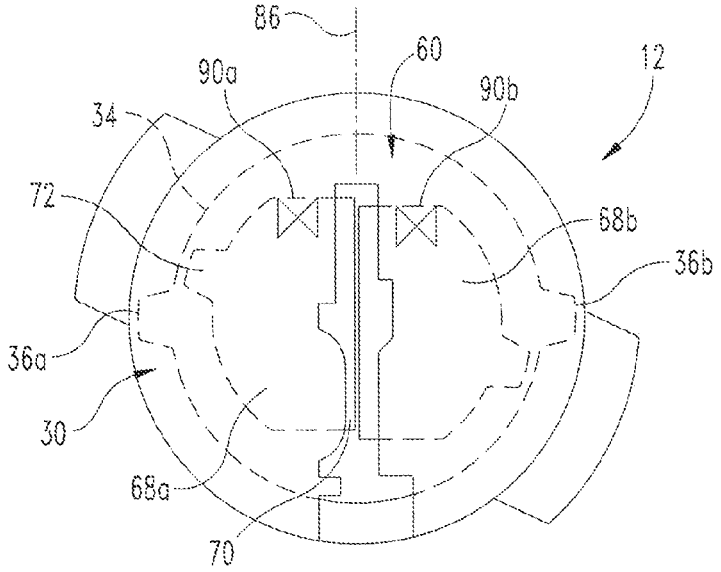
FIG. 4 is a diagrammatic cross-sectional view of the plug assembly of FIG. 1 in an unlocked state.

Blocking members 68*a*, 68*b* are movable in their respective slot 66*a*, 66*b* between a first position, shown in FIGS. 2 and 3, and a second position, shown in FIGS. 3 and 4. In the first position, blocking members 68*a*, 68*b* are positioned so that they do not extend into or obstruct keyway 64. In the second position, blocking members 68*a*, 68*b* are positioned so they extend into and obstruct keyway 64. In order to move blocking members 68*a*, 68*b* from the first position to the second position, plug body 60 is rotated away from a home position indicated by the relative positioning in FIGS. 2 and 3 between plug body 60 and plug housing 30. Biasing members 90*a*, 90*b* can be provided to bias blocking members 68*a*, 68*b*, respectively, into the first position when the plug body 60 is in the home position.

Key 14 includes a blade 16 and a bow 18. Blade 16 can include any suitable configuration for a key blade. Blade 16 has opposite sides 22*a*, 22*b* extending along the length of blade 16. In addition, blade 16 includes a number of receptacles 20*a*, 20*b* opening at respective ones of the opposite sides 22*a*, 22*b* of blade 16. Receptacles 20*a*, 20*b* are sized and spaced to receive respective ones of the blocking members 68*a*, 68*b* when plug body 60 is rotated from the home position to the second position indicated in FIGS. 4 and 5.

Blocking members 68*a*, 68*b* will now be further described with reference to blocking member 68*a*, it being understood that blocking member 68*b* can be configured similarly, and blocking members 68*a*, 68*b* are referred to collectively as blocking member 68. It should be understood that more than two blocking members 68, slots 66*a*, 66*b*, and receptacles 20*a*, 20*b* in blade 16 are contemplated. Furthermore, each of the blocking member 68 need not be identically configured to one another, and the respective slot and receptacle that receives the respective blocking member can be sized and configured accordingly to match the size and shape of the blocking member to be received therein.

In the illustrated embodiment, blocking member 68 includes a plate body 74. In one embodiment, plate body 74 defines a shape that is a sector, such as a section of a circle or oval. Plate body 74 includes a curved outer edge 76 positioned along an inner surface 34 of chamber 32 of plug housing 30. Plate body 74 further includes a first inner edge 78 and a second inner edge 80 that are linear and extend toward one another from opposite ends of curved outer edge 76. Inner edges 78, 80 extend radially inwardly to intersect at an intersection 82. Plate body 74 may also include a flange 84 to support biasing member 90*a* against plug body 60 to normally bias blocking member 68 radially outwardly against inner surface 34.

Inner surface 34 of plug housing 30 defines first and second detents 36*a*, 36*b* on opposite sides of the inner surface of plug housing 30. First and second detents 36*a*, 36*b* receive respective ones of the cam portions 72*a*, 72*b* (collectively cam portions 72) extending radially outwardly from the curved outer edge 76 of a respective one of the blocking members 68*a*, 68*b* when the blocking members 68 are in the home or first position of FIGS. 2 and 3. Cam portions 72 can include a radially outward tapered configuration and are sized and shaped to be received in a correspondingly sized and shaped one of the detents 36*a*, 36*b*. The tapered configuration allows the cam portions 72 to slide out of detents 36*a*, 36*b* while compressing biasing members 90*a*, 90*b* to maintain contact with inner surface 34 while plug body 60 is rotated in plug housing 30 from the home position to the second position of FIGS. 4 and 5.

Figure 5:
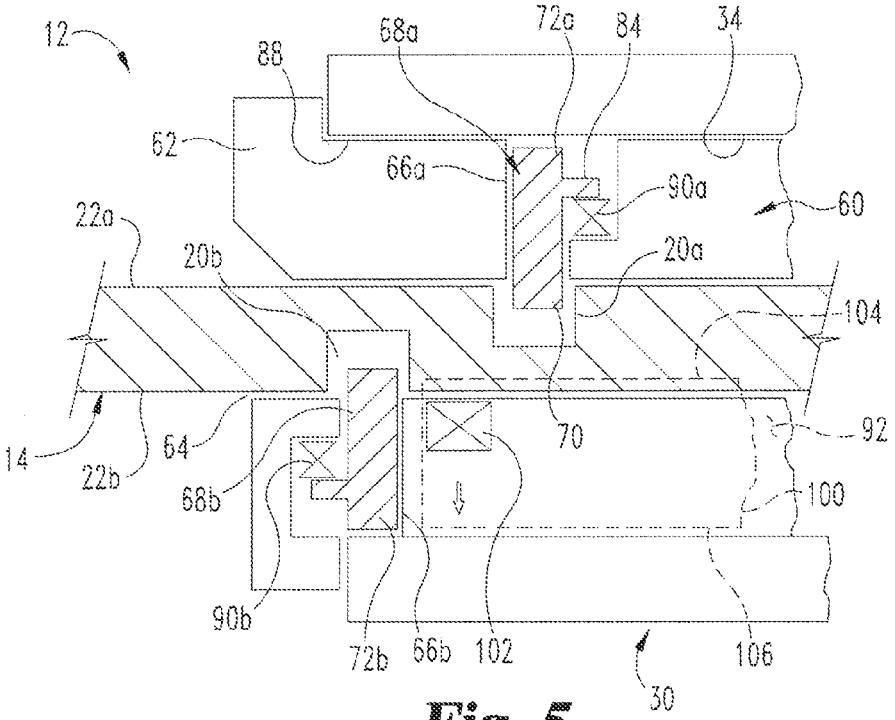
FIG. 5 is a diagrammatic longitudinal section view of the plug assembly of FIG. 4 with the key in the keyway, and further including a sidebar locking device according to one embodiment.

When plug body 60 is in the first or home position relative to plug housing 30 as shown in FIGS. 2 and 3, keyway 64 is unobstructed by blocking members 68*a*, 68*b*. When plug body 60 is rotated from the home position, blocking members 68*a*, 68*b* are displaced by cam portions 72 acting on inner surface 34 so that blocking portions 70 on the radial inner side of blocking members 68 extend into keyway 64, as shown in FIGS. 4 and 5. In the illustrated embodiment, the second inner edges 80 are aligned, or are nearly aligned, with central vertical axis 86 on the center of keyway 64 so that any object in keyway 64 is jammed, or is prevented from being inserted into keyway 64. In other embodiments, inner edges 80 are positioned in overlapping relation relative to one another and/or to central vertical axis 86 when plug body 60 is rotated from the home position. In addition, the heights of blocking portions 70 extend along a majority of the height of keyway 64 along vertical axis 86. In any event, blocking members 68*a*, 68*b* jam and/or block insertion of any pick tool or bump key in keyway 64 when plug cylinder 60 is rotated, preventing further operation of the lock 10. Alternatively, when key 14 is inserted and rotation of plug body 60 is initiated, blocking members 68*a*, 68*b* are received in receptacles 20*a*, 20*b* and key 14 can be used to further rotate the plug cylinder 60 to operate the lock.

Although blocking members 68 can be employed with a pin-type tumbler arrangement, the illustrated embodiment includes a locking sidebar 100 housed in an axial groove 92 of plug body 60. The sidebar 100 is biased radially outwardly with, for example, one or more biasing members 102, and includes a radially inwardly facing interference portion 104 that communicates with keyway 64 and an opposite radially outwardly facing tapered portion 106. Tapered portion 106 can be rectilinear or curvilinear in configuration. Upon insertion of key 14, the key 14 engages the sidebar 100 and a number of rack pins (not shown) to allow operation of the lock. Further examples of various embodiments of cylinder and sidebar arrangement can be found in commonly owned U.S. patent application Ser. No. 14/194,546 filed on Feb. 28, 2014, and U.S. patent application Ser. No. 14/176,037 filed on Feb. 7, 2014, each of which is incorporated herein by reference in its entirety for all purposes.

Figure 6:
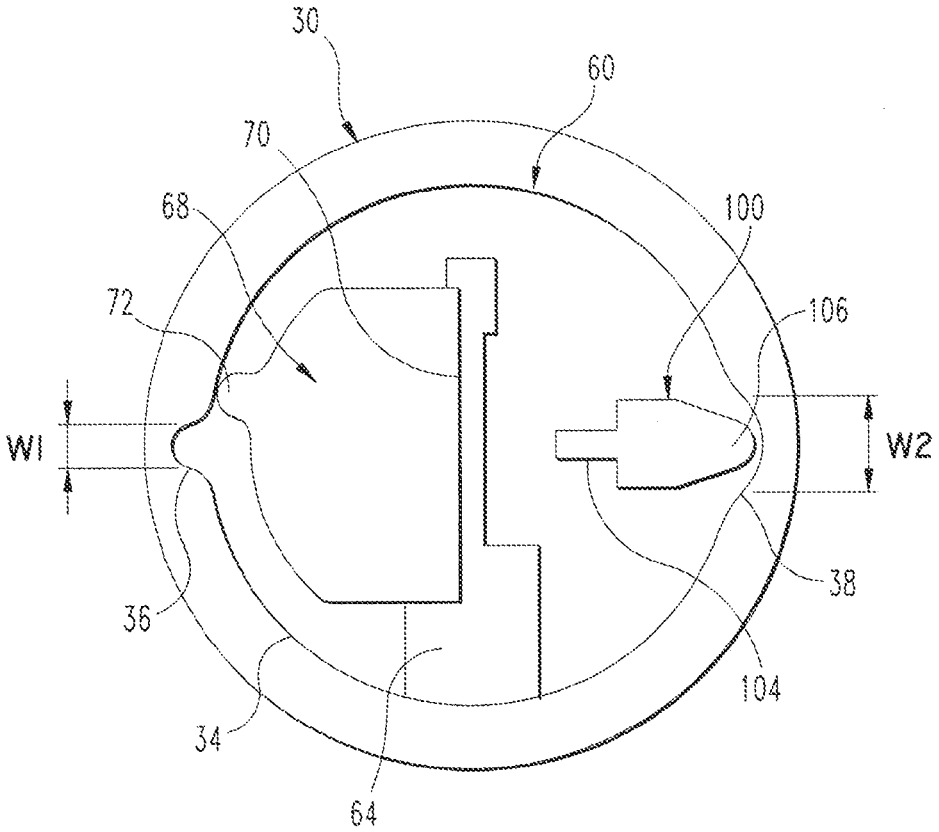
FIG. 6 is a diagrammatic cross-sectional view of the plug assembly of showing the sidebar locking device and one of the blocking members.

As further shown in FIG. 6, tapered portion 106 is normally received in a groove 38 in the inner surface 34 of plug housing 30 and cam portions 72 (only one of which is shown for clarity) are received in detents 36 when lock 10 is in the home position. In the circumferential direction around inner surface 34, groove 38 includes a width W2 that is greater than a width W1 of detents 36. Thus, when plug body 60 is initially rotated as shown in FIG. 6 from the home position, cam portions 72 are removed from detents 36 to displace blocking portions 70 into keyway 64. However, tapered portion 106 of sidebar 100 remains in groove 38 until plug body 60 is rotated further. This arrangement allows blocking members 68 to obstruct keyway 64 before the primary locking function provided by sidebar 100 is removed by displacement of tapered portion 106 out of groove 38 toward keyway 64. When a proper key is inserted, each rack pin has a notch aligned with the interference portion 104 to allow radially inward displacement of sidebar 100, and each blocking member 68 is received in a receptacle defined by blade 16 of the inserted key 14. This defines an unlocked state of the lock 10, in which the sidebar 100 is free to move radially inward. When a proper key is not inserted, at least one of the rack pins does not have a notch aligned with the interference portion 104. This defines a locked state of the lock 10, in which the sidebar 100 is prevented from moving radially inward. Tapered portion 106 remains engaged to plug housing 30 in groove 38, preventing plug cylinder 60 from rotating.

Various aspects of the present disclosure are contemplated. For example, according to one aspect a plug assembly for a lock is provided. The plug assembly includes a substantially cylindrical plug body with a keyway extending along a longitudinal axis of the plug body and at least two slots extending from an outer surface of the plug body to the keyway. At least one of the slots is positioned on a first side of the keyway and at least one of the slots is positioned on a second side of the keyway. The apparatus also includes at least two blocking members in respective ones of the at least two slots. Each blocking member includes a blocking portion on a radially inward side of the blocking member and a cam portion on a radially outer side of the blocking member. The apparatus also includes a substantially cylindrical plug housing for receiving the plug body. The plug housing includes an inner surface with at least one detent on each of opposite sides of the plug housing to receive the cam portion of a respective one of the blocking members. The at least two blocking members are biased to position the cam portion thereof in the respective detent so the blocking portions are not located in the keyway when the plug body is in a first position relative to the plug housing. Rotation of the plug body relative to the plug housing from the first position displaces the cam portions from the respective detent to move the at least two blocking members radially inwardly relative to the plug body and position the blocking portion of each blocking member in the keyway.

In one embodiment, the plug assembly includes an axial channel extending in the plug body opening in the keyway and at the outer surface. A locking sidebar is positioned in the axial channel. The sidebar includes an interference portion on a radially inner side of the sidebar, and a tapered portion on a radially outer side of the sidebar. The plug housing includes a groove. The tapered portion of the sidebar is biased into the groove with the plug body in the first position. The groove is sized so that rotation of the plug body positions the blocking portions of the blocking members in the keyway before the tapered portion of the sidebar is displaced from the groove to move the sidebar into the keyway. In a refinement of this embodiment, in a circumferential direction around the inner surface of the plug housing, the groove defines a first width and each of the detents defines a second width, and the first width is greater than the second width.

In another embodiment, each of the cam portions is tapered. In yet another embodiment, the blocking portions extend along a majority of a height of the keyway when in positioned in the keyway. In another embodiment, the blocking portions of the at least two blocking members overlap one another across a center vertical axis of the keyway when the plug body is rotated from the first position. In still another embodiment, the blocking portions of the at least two blocking members do not overlap a center vertical axis of the keyway when the plug body is rotated from the first position.

In another embodiment, each of the at least two blocking members includes a plate body. The plate body includes a curved outer edge extending along the inner surface of the plug housing and the cam portion projects outwardly from the curved outer edge. In a refinement of this embodiment, the plate body includes two linear inner edges extending radially inwardly from opposite ends of the curved outer edge. In a further refinement of this embodiment, the two linear edges intersect one another so the plate body defines a sector.

According to another aspect, a method of obstructing a keyway of a lock is provided. The method includes positioning a first blocking member and a second blocking member outside of the keyway when a plug body defining the keyway is in a first position relative a plug housing receiving the plug body. The first blocking member and the second blocking member are located within the plug body on opposite sides of the keyway. The method also includes rotating the plug body relative to the plug housing to displace the first blocking member and the second blocking member radially inwardly into the keyway so that the first and second blocking members obstruct the keyway.

In one embodiment of the method, positioning the first blocking member and the second blocking member includes biasing the first blocking member and the second blocking member radially outwardly into contact with an inner surface of the plug housing. In a refinement of this embodiment, the first blocking member includes a first cam portion and the second blocking member includes a second cam portion, and the first and second cam portions are received in respective ones of a first detent and a second detent in the inner surface of the plug housing When the plug body is in the first position. In still another embodiment, rotating the plug body includes displacing the first cam portion and the second cam portion out of respective ones of the first detent and the second detent and into contact with the inner surface of the plug housing.

In another embodiment of the method, rotating the plug body includes turning a key inserted in the keyway and the radially inwardly displaced first blocking member and second blocking member are received in respective ones of a first receptacle and a second receptacle defined by the key. In yet another embodiment, the radially inwardly displaced first and second blocking members overlap one another in the keyway when viewed in a direction along a longitudinal axis of the plug body that extends along the keyway.

According to another aspect, a system includes a plug assembly for a lock. The plug assembly includes a substantially cylindrical plug body with a keyway extending along a longitudinal axis of the plug body and at least first and second blocking members housed in the plug body on opposite sides of the keyway. Each blocking member including a blocking portion on a radially inward side of the blocking member and a cam portion on a radially outer side of the blocking member. A substantially cylindrical plug housing receives the plug body. The plug housing includes an inner surface with at least one detent on each of opposite sides of the plug housing to receive the cam portion of a respective one of the blocking members. Each of the first and second blocking members is biased to position the cam portion thereof in the respective detent so the blocking portions are not located in the keyway when the plug body is in a first position relative to the plug housing. Rotation of the plug body relative to the plug housing from the first position displaces the cam portions of the first and second blocking members from the respective detents and displaces the blocking members radially inwardly relative to the plug body to position the blocking portion of each blocking member in the keyway. The system also includes a key for the lock. The key includes a blade positionable in the keyway, and the key includes a first receptacle and a second receptacle along the blade that are sized and positioned relative to one another to receive respective ones of the blocking portions of the first and second blocking members when the blade is positioned in the keyway and the plug body is rotated relative to the plug housing from the first position.

In one embodiment of the system, the first and second blocking members are positioned in respective ones of first and second slots defined by the plug body, and the slots extend between an outer surface of the plug body and the keyway. In another embodiment, the blocking portions overlap one another across a center vertical axis of the key when the blocking members are positioned in the keyway. In still another embodiment, the blocking portion of each blocking member extends along a majority of a height of the keyway when the blocking portion is positioned in the keyway.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a plug assembly for a lock, the plug assembly including:

a substantially cylindrical plug body comprising:

a keyway extending along a longitudinal axis of the plug body;

at least two slots extending from an outer surface of the plug body to the keyway, at least one of the slots being positioned on a first side of the keyway and at least one of the slots being positioned on a second side of the keyway, the at least two slots being spaced axially from one another along the keyway;

at least two blocking members in respective ones of the at least two slots, each blocking member including a blocking portion on a radially inward side of the blocking member and a cam portion on a radially outer side of the blocking member; and a substantially cylindrical plug housing for receiving the plug body, the plug housing including an inner surface with at least one detent on each of opposite sides of the plug housing to receive the cam portion of a respective one of the blocking members, wherein the at least two blocking members are biased to position the cam portion thereof in the respective detent so the blocking portions are not located in the keyway when the plug body is in a first position relative to the plug housing, and wherein rotation of the plug body relative to the plug housing from the first position displaces the cam portions from the respective detent to move the at least two blocking members radially inwardly relative to the plug body and position the blocking portion of each blocking member in the keyway.

2. The apparatus according to claim 1, wherein each of the cam portions is tapered.

3. The apparatus according to claim 1, wherein the blocking portions extend along a majority of a height of the keyway when in positioned in the keyway.

4. The apparatus according to claim 1, wherein the blocking portions of the at least two blocking members overlap one another across a center vertical axis of the keyway when the plug body is rotated from the first position.

5. The apparatus according to claim 1, wherein the blocking portions of the at least two blocking members do not overlap a center vertical axis of the keyway when the plug body is rotated from the first position.

6. An apparatus comprising:

a plug assembly for a lock, the plug assembly including:

a substantially cylindrical plug body comprising:

a keyway extending along a longitudinal axis of the plug body;

at least two slots extending from an outer surface of the plug body to the keyway, at least one of the slots being positioned on a first side of the keyway and at least one of the slots being positioned on a second side of the keyway;

at least two blocking members in respective ones of the at least two slots, each blocking member including a blocking portion on a radially inward side of the blocking member and a cam portion on a radially outer side of the blocking member;

a substantially cylindrical plug housing for receiving the plug body, the plug housing including an inner surface with at least one detent on each of opposite sides of the plug housing to receive the cam portion of a respective one of the blocking members, wherein the at least two blocking members are biased to position the cam portion thereof in the respective detent so the blocking portions are not located in the keyway when the plug body is in a first position relative to the plug housing, and wherein rotation of the plug body relative to the plug housing from the first position displaces the cam portions from the respective detent to move the at least two blocking members radially inwardly relative to the plug body and position the blocking portion of each blocking member in the keyway;

wherein the plug assembly includes:

an axial channel extending in the plug body opening in the keyway and at the outer surface;

a sidebar positioned in the axial channel, the sidebar comprising an interference portion on a radially inner side of the sidebar, and a tapered portion on a radially outer side of the sidebar; and the plug housing including a groove, the tapered portion of the sidebar being biased into the groove with the plug body in the first position, wherein the groove is sized so that rotation of the plug body positions the blocking portions of the blocking members in the keyway before the tapered portion of the sidebar is displaced from the groove to move the sidebar into the keyway.

7. The apparatus of claim 6, wherein, in a circumferential direction around the inner surface of the plug housing, the groove defines a first width and each of the detents defines a second width, the first width being greater than the second width.

8. An apparatus comprising:

a plug assembly for a lock, the plug assembly including:

a substantially cylindrical plug body comprising:

a keyway extending along a longitudinal axis of the plug body;

at least two slots extending from an outer surface of the plug body to the keyway, at least one of the slots being positioned on a first side of the keyway and at least one of the slots being positioned on a second side of the keyway;

at least two blocking members in respective ones of the at least two slots, each blocking member including a blocking portion on a radially inward side of the blocking member and a cam portion on a radially outer side of the blocking member;

a substantially cylindrical plug housing for receiving the plug body, the plug housing including an inner surface with at least one detent on each of opposite sides of the plug housing to receive the cam portion of a respective one of the blocking members, wherein the at least two blocking members are biased to position the cam portion thereof in the respective detent so the blocking portions are not located in the keyway when the plug body is in a first position relative to the plug housing, and wherein rotation of the plug body relative to the plug housing from the first position displaces the cam portions from the respective detent to move the at least two blocking members radially inwardly relative to the plug body and position the blocking portion of each blocking member in the keyway, wherein each of the at least two blocking members includes a plate body, the plate body including a curved outer edge extending along the inner surface of the plug housing and the cam portion projects outwardly from the curved outer edge.

9. The apparatus of claim 8, wherein the plate body includes two linear inner edges extending radially inwardly from opposite ends of the curved outer edge.

10. The apparatus of claim 9, wherein the two linear edges intersect one another so the plate body defines a sector.

11. A method of obstructing a keyway of a lock, the method comprising:

positioning a first blocking member and a second blocking member outside of the keyway when a plug body defining the keyway is in a first position relative a plug housing receiving the plug body, wherein the first blocking member and the second blocking member are located within the plug body on opposite sides of the keyway; and rotating the plug body relative to the plug housing to displace the first blocking member and the second blocking member radially inwardly into the keyway so that the first and second blocking members obstruct the keyway, wherein the radially inwardly displaced first and second blocking members overlap one another in the keyway when viewed in a direction along a longitudinal axis of the plug body that extends along the keyway.

12. The method of claim 11, wherein positioning the first blocking member and the second blocking member includes biasing the first blocking member and the second blocking member radially outwardly into contact with an inner surface of the plug housing.

13. The method of claim 12, wherein the first blocking member includes a first cam portion and the second blocking member includes a second cam portion, the first and second cam portions being received in respective ones of a first detent and a second detent in the inner surface of the plug housing when the plug body is in the first position.

14. The method of claim 13, wherein rotating the plug body includes displacing the first cam portion and the second cam portion out of respective ones of the first detent and the second detent and into contact with the inner surface of the plug housing.

15. The method of claim 11, wherein rotating the plug body includes turning a key inserted in the keyway and the radially inwardly displaced first blocking member and second blocking member are received in respective ones of a first receptacle and a second receptacle defined by the key.

16. A system comprising:

a plug assembly for a lock, the plug assembly including:

a substantially cylindrical plug body comprising a keyway extending along a longitudinal axis of the plug body and at least first and second blocking members housed in the plug body on opposite sides of the keyway, each blocking member including a blocking portion on a radially inward side of the blocking member and a cam portion on a radially outer side of the blocking member;

a substantially cylindrical plug housing for receiving the plug body, the plug housing including an inner surface with at least one detent on each of opposite sides of the plug housing to receive the cam portion of a respective one of the blocking members, wherein each of the first and second blocking members is biased to position the cam portion thereof in the respective detent so the blocking portions are not located in the keyway when the plug body is in a first position relative to the plug housing, and wherein rotation of the plug body relative to the plug housing from the first position displaces the cam portions of the first and second blocking members from the respective detents and displaces the blocking members radially inwardly relative to the plug body to position the blocking portion of each blocking member in the keyway; and a key for the lock, the key including a blade positionable in the keyway, wherein the key includes a first receptacle and a second receptacle along the blade that are sized and positioned relative to one another to receive respective ones of the blocking portions of the first and second blocking members when the blade is positioned in the keyway and the plug body is rotated relative to the plug housing from the first position, wherein the blocking portions overlap one another across a center vertical axis of the key when the blocking members are positioned in the keyway.

17. The system of claim 16, wherein the first and second blocking members are positioned in respective ones of first and second slots defined by the plug body, the slots extending between an outer surface of the plug body and the keyway.

18. A system comprising:

a plug assembly for a lock, the plug assembly including:

a substantially cylindrical plug body comprising a keyway extending along a longitudinal axis of the plug body and at least first and second blocking members housed in the plug body on opposite sides of the keyway, each blocking member including a blocking portion on a radially inward side of the blocking member and a cam portion on a radially outer side of the blocking member;

a substantially cylindrical plug housing for receiving the plug body, the plug housing including an inner surface with at least one detent on each of opposite sides of the plug housing to receive the cam portion of a respective one of the blocking members, wherein each of the first and second blocking members is biased to position the cam portion thereof in the respective detent so the blocking portions are not located in the keyway when the plug body is in a first position relative to the plug housing, and wherein rotation of the plug body relative to the plug housing from the first position displaces the cam portions of the first and second blocking members from the respective detents and displaces the blocking members radially inwardly relative to the plug body to position the blocking portion of each blocking member in the keyway; and a key for the lock, the key including a blade positionable in the keyway, wherein the key includes a first receptacle and a second receptacle along the blade that are sized and positioned relative to one another to receive respective ones of the blocking portions of the first and second blocking members when the blade is positioned in the keyway and the plug body is rotated relative to the plug housing from the first position, wherein the blocking portion of each blocking member extends along a majority of a height of the keyway when the blocking portion is positioned in the keyway.

* * * * *